United States Patent [19]

Akred, Sr.

[11] 4,216,471

[45] Aug. 5, 1980

[54] CONTROL SYSTEM FOR DISPLAY DEVICES AND METHOD

[75] Inventor: Ronald J. Akred, Sr., St. Clair, Mich.

[73] Assignee: Baker Electrical Products, Inc., Marine City, Mich.

[21] Appl. No.: 943,132

[22] Filed: Sep. 18, 1978

[51] Int. Cl.[2] ..... G09F 9/32

[52] U.S. Cl. ..... 340/764; 340/752; 340/756; 340/802

[58] Field of Search ..... 340/764, 802, 752, 756, 340/766

[56] References Cited

U.S. PATENT DOCUMENTS

| | | | |
|---|---|---|---|
| 3,406,387 | 10/1968 | Werme | 340/799 X |
| 3,594,762 | 7/1971 | Gardberg et al. . | |
| 3,594,778 | 7/1971 | Herald et al. . | |
| 3,638,215 | 1/1972 | Payne . | |
| 3,651,511 | 3/1972 | Andrews et al. . | |
| 3,750,138 | 7/1973 | Burgan et al. . | |
| 3,877,008 | 4/1975 | Payne | 340/756 X |
| 3,932,859 | 1/1976 | Kyriakides et al. | 340/756 X |
| 4,024,531 | 5/1977 | Ashby . | |
| 4,072,937 | 2/1978 | Chu . | |
| 4,122,395 | 10/1978 | Schotz et al. | 340/802 X |

*Primary Examiner*—David L. Trafton

*Attorney, Agent, or Firm*—Burton, Parker & Schramm

[57] ABSTRACT

Control system for a display with a matrix of image forming dots. The control system includes a single-board computer with an erasable programmable read-only memory unit which sends a series of electrical pulses to a drive module. The drive module responds to the electrical pulses by inducing in the display dot by dot formation of an image selected by the operator, the control system characterized by very low power usage due to current flowing by only one dot at a time.

9 Claims, 2 Drawing Figures

CONTROL SYSTEM FOR DISPLAY DEVICES AND METHOD

BACKGROUND OF THE INVENTION

The present invention relates to the control of display devices made of a matrix of display units where the taking of a dynamic or quiescent mode by the display units will cause an image to form on the display device.

Practical display devices employing arrays of light-emitting diodes, dots that flip, and other units capable of displaying dynamic and quiescent modes have been in use for many years. Display panels comprising a large number of such units in a rectangular array and capable of simultaneously displaying many symbols in a dot matrix form are commercially available. A typical dot matrix for displaying a selected symbol consists of an array of 35 dots arranged in a 7×5 array.

Previous display systems, however, have had the disadvantage of requiring relatively large amounts of current flow to form the images upon the displays. In particular, U.S. Pat. Nos. 3,638,215, 3,651,511 and 4,024,531, show the display signs which are activated column by column. Thus, when a display requires changing a whole column, all of the rows will have current flowing through them at the same time. In fact, some displays, such as the one shown in U.S. Pat. No. 3,750,138, call for changing the display a character at a time with even greater resultant energy use. Although U.S. Pat. No. 4,072,937 does disclose a method for writing or erasing a single cell, it is done through use of currents sent through all of the units in that column and row.

This problem becomes particularly acute with respect to signs used on moving vehicles such as buses which must carry their own power supply. Buses have been limited in the past to carrying signs consisting of endless tapes each of which carries a number of messages. This type of system has a number of different disadvantages. For instance, only a limited number of messages may be used and if it is desired to add a new message or change a message, it is necessary to change the entire tape. Although numerous types of electronic visual display systems have been proposed for a moving vehicle, none have gained acceptance.

SUMMARY OF THE INVENTION

According to the present invention, there is provided a control system ideally suited for use on moving vehicles, such as buses. The present invention uses many commercially available units which are combined to provide a control system with very low power requirements while providing wide variety and flexibility with respect to the messages available. This control system consists of an input device, a computer and a drive module. The input device is used for indicating the image which the operator wishes to form on the display. The computer responds to the input device by directing a series of electrical pulse groups corresponding to the image into the drive module where the pulse groups induce in a display of a matrix of image forming display units separate unit by unit sequential formation of the desired image. This unit by unit formation is characterized by current flow through only one display unit at a time, thus keeping the power usage to a minimum. The computer may contain a memory, preferrably an erasable programmable read-only memory unit for storing codes corresponding to images that may be selected. It is important in the invention to use the unit by unit activation method since directing current through more than one unit at a time increases the power usage.

BRIEF DESCRIPTION OF THE DRAWING

The invention may be more clearly understood from the accompanying drawing in which.

DESCRIPTION OF PREFERRED EMBODIMENTS

Figure 1:
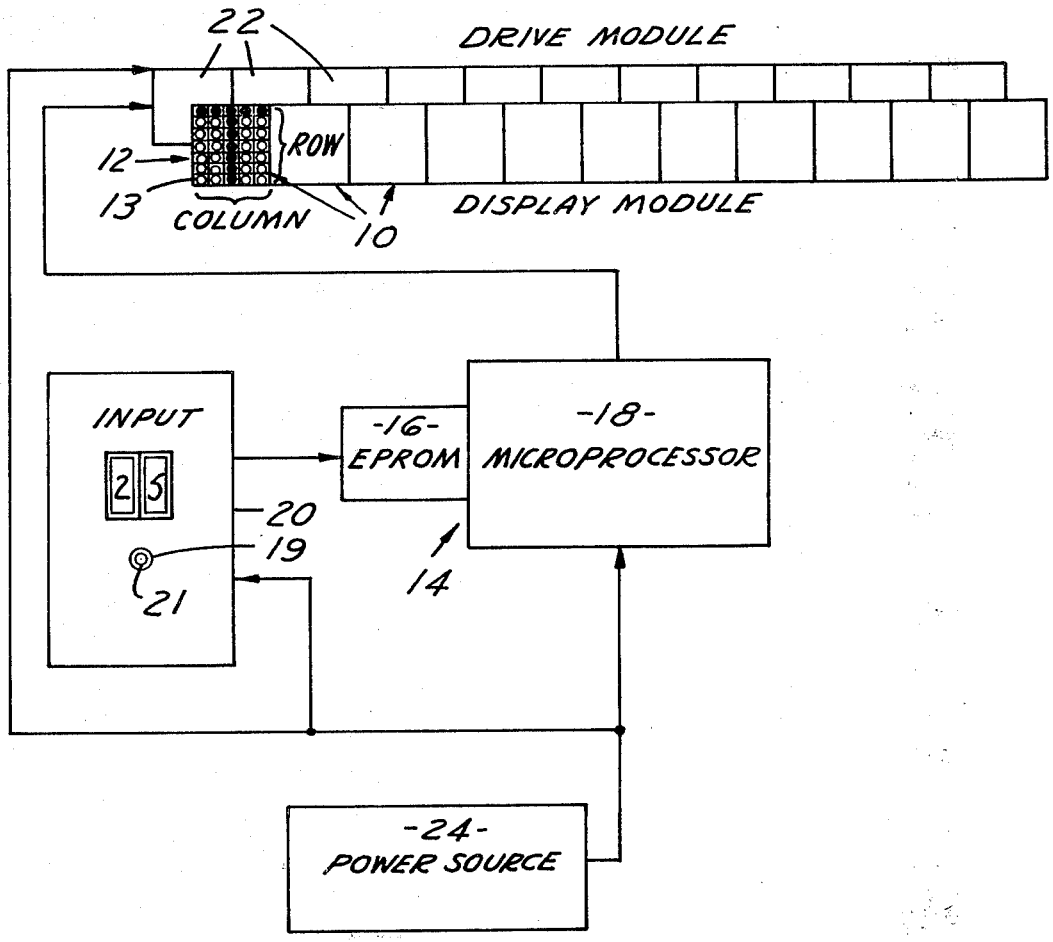
FIG. 1 shows a display system embodying the principles of the present invention in block diagram form.

The present invention relates to an improved method of displaying images and a method for displaying images. As shown in FIG. 1 the basic components of this display system include a number of display modules 10, each module consisting of a matrix of display units 12 arranged in rows and columns, a computer 14 which includes both a memory 16 and a processing unit 18, an input device 20 and drive modules 22. Also there is shown a power source 24.

Each display module 10 according to the preferred embodiment of the invention and in order to achieve the objective of minimizing the power requirements is an electro-mechanical matrix of display units 12 in the form of dots 13 arranged in a number of columns and rows. Each dot consists of a thin flat disc having a colored side and a dark side. Each such disc is rotatively mounted to expose one side or the other, which discs are available commercially in various arrays, such as the 5×7 array shown in FIG. 1. Such arrays are presently sold by Ferranti-Packard Limited of Ontario, Canada. In this type of array each display unit consists of two parts, an indicator dot 13 and an encapsulated coil assembly (not shown). The indicator dot is a pivoted disc free to rotate in a housing. The disc is permanently magnetized. The coil assembly (not shown) consists of a U-shaped electro-magnetic core with a coil wound around it. There is no mechanical driving linkage between the electro-magnet and the magnetized disc in that magnetic forces provide the drive.

The particularly desirable feature of these display units is that power is only required to change the state. For example, assume that the disc has its colored side showing. The residual magnetism maintains the disc in this position until current is applied to the coil in one direction, whereupon the disc will flip to expose its dark side. The disc is now magnetically held in this position until current passes through the coil in the opposite direction. It is therefore apparent that the operator can select an image and continue to display the image for an indefinite period of time in spite of the fact the power is only required during the actual process of setting up a message on the display. It should be noted that the current passing through the coil must have a minimum voltage requirement. In this embodiment it is considered 10 volts.

Another desirable feature of this type of display unit is that they are highly visible. Dots are presently available having a diameter of ½ inch and having one side colored a bright orange. Where such dots are used, they are easily visible for at least 500 feet.

It is intended that this invention is not to be limited to this type of display unit but can be used to activate light circuits or other types of displays.

When a dot is dark it is considered as being quiescent. When lighted or showing its colored side, it is said to be in its dynamic mode.

Computer 14 in this preferred embodiment consists of a microprocessor 18 as its processing unit and an erasable programmable read-only memory (EPROM) 16 in which may be stored codes that correspond with images to be displayed. The microprocessor is a common consumer item, such as the INTEL (registered trademark of the Intel Corporation) 8080A single chip 8 bit n-channel microprocessor. Likewise EPROMs compatible with the microprocessor are also commercially available. The EPROM comes initially blank and can then be programmed. Under a proper light source it can be erased and then reprogrammed. It should be noted that read-only memories (ROMs) can also be used, though without the flexibility of an EPROM unit.

The input device 20 is shown as a thumb wheel device. Different images to be displayed may be selected by turning the wheel 19. There is also provided an "initiate" button 21 on the input device. The thumb wheel input is only one type of system which can be used as the input device. Other devices which can be used for entry of an image are keyboards, card readers, tape readers and even telephone lines. These are also commercially available units.

The special feature of the invention is the drive module 22 (shown in FIG. 2) which allows the separate dot by dot sequential display of images. Each of these modules in this embodiment has 13 lines connected to a computer parallel interface 26. The interface allows the signals coming from the computer to be entered into all of the drive modules simultaneously. The lines entering into the drive module from the interface 26 are divided into four groups symbolized by the letters A, B, C and D respectively. A represents the clear set input line. B receives binary coded decimal (BCD) signals for row actuation. C represents the input lines for BCD data for module selection. Group D represents input lines for column selection. Although the embodiment in FIG. 2 has 13 inputs from the parallel interface, this number can be varied to correspond to larger or smaller matrices of display units to be controlled by the driver module. The 5×7 matrix used in this embodiment is only used as an example. In fact, since this invention uses a dot by dot actuation system rather than by whole row or column or display actuation, users of this invention have greater freedom to use non-standard size matrices than in the prior art where a 5×7 matrix is used since it allows the formation of standard size alphanumeric characters.

Operation of the control system is initiated by the selection of an image on the thumb wheel 20 and then the depression of the "initiate" button 21. This triggers the computer 14 to read the image selected on the thumb wheel and automatically initiates a search of the computer memory 16 for the code corresponding to that image. This code then instructs the microprocessor 18 to output a series of electrical pulse groups along the computer parallel interface 26 to the drive modules 22.

Figure 2:
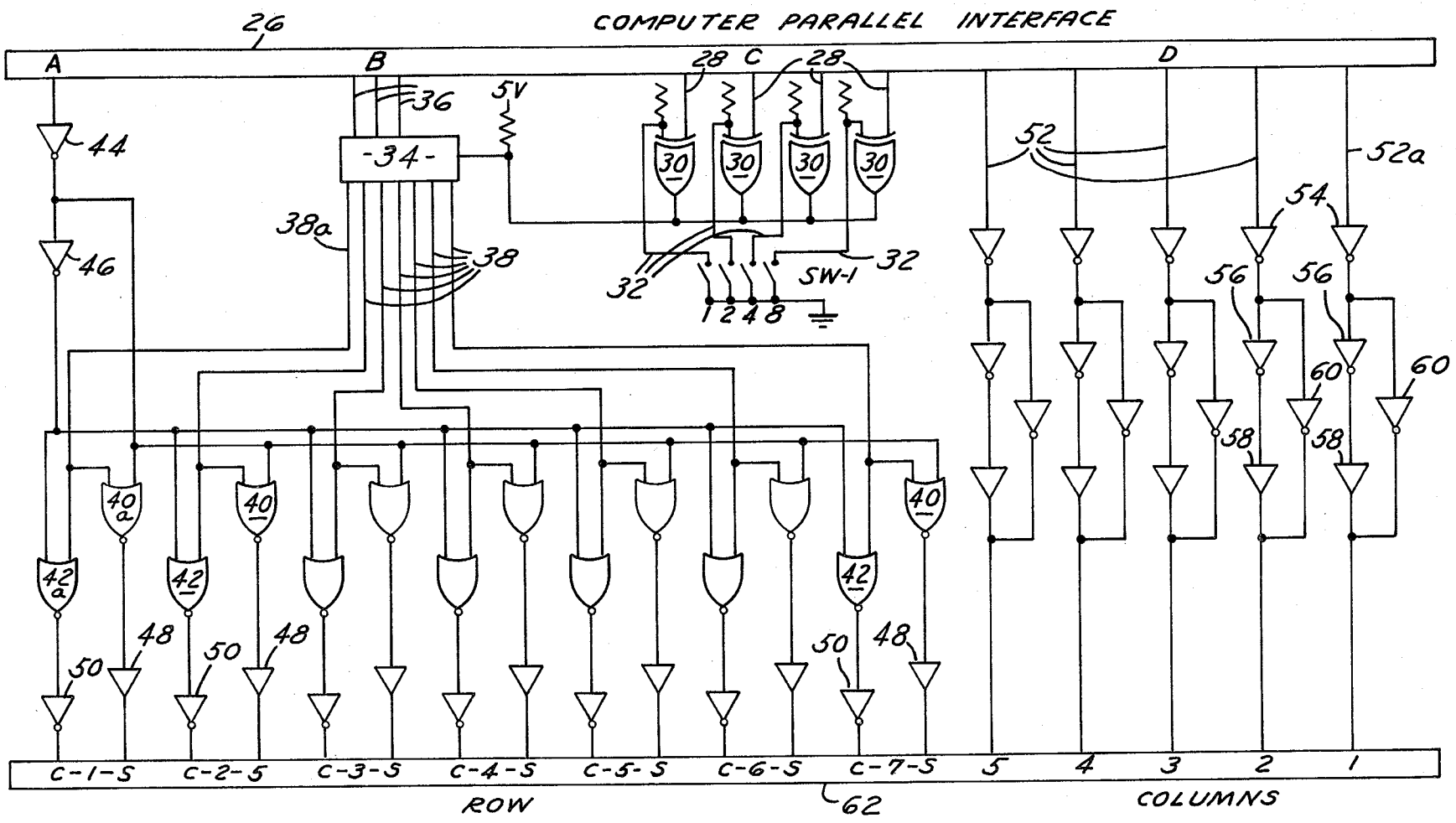
FIG. 2 depicts a logic circuit for a drive module.

Turning now to FIG. 2 where a drive module is shown schematically for the operation of the drive modules 22, it is noted that all the drive modules are essentially the same. However, each drive module is activated separately from the other drive modules due to the setting of drive module selection switch SW-1. This switch may be set to represent any number from 0 to 15 in a binary code. Thus, the first drive module may be identified by closing the switch at SW-1 labeled 1 while leaving the switches at SW-1 numbered 2, 4 and 8 open.

The output supplied by the microprocessor to the drive module is parallel data; in other words, the data transmitted to the first drive module will also be transmitted to the second drive module on down the line until the last drive module has the data. However, so long as the proper binary coded decimal signal corresponding to that drive module's selection switch SW-1 is not sent through module input C, the drive module will ignore the data, although some of the module circuits will be initiated on every signal coming from the microprocessor.

It should be noted that the input along the parallel interface 26 is in terms of negative logic, where 0 is equal to +5 volts, and a 1 is essentially ground or 0 volts. The input along parallel interface 26 at A, B and D is positive logic where +5 volts is represented by a logical 1 and ground is represented by a logical 0.

If, for example, the image selected requires a black dot at the display unit in matrix position Column 1, Row 1 of the first display module, the corresponding drive module would have to be activated. If this module was set at 1 at the drive module selector switch SW-1 (as described above), to activate the module the computer would send an input through the parallel interface of 1,0,0,0 as read on the C input lines 28 from left to right. This C input would enter the EXCLUSIVE OR gates 30 and would correspond to the 0,1,1,1 input coming through lines 32, resulting in a 0 output (+5 v) from each of the EXCLUSIVE OR gates 30. This would then activate encoder 34 allowing it to interpret the parallel interface input coming from the B input lines 36. Any other C input would result in one of more of the EXCLUSIVE OR gates 30 outputting a logical 1 or ground which would prevent the encoder 34 from activating. This would prevent any display units 12 controlled by this drive module from receiving a current.

The B input is in terms of binary coded decimal data with row 1 represented by a 0,0,1 on the B input lines 36 reading from left to right. This B input would be interpreted by the encoder to send logical ones along all its output lines 38 except the output line corresponding to row 1 *38a*, the row to be controlled, where a logical 0 is sent. Each of the encoder output lines then enter two NOR gates 40, 42 at the same time the NOR gates receive a second input resulting from the parallel interface A input. Since the selected image will have a black dot in Row 1, Column 1, the parallel interface input at A should be a logical 0. This A input passes through inverter 44 and becomes a logical 1. This logical 1 is entered into NOR gates 40 and is also passed through inverter 46 where it is changed back to a logical 0 which is inputed into NOR gates 42. Thus the "set" NOR gate corresponding to Row 1 *40a* will have an input of a 0 and a 1 resulting in a 0 output of essentially ground. This signal then passes through driver 48 and remains at essentially ground. This is the row 1 "S" output. At the same time the "clear" NOR gate corresponding to row 1 *42a* has received two logical 0 inputs causing it to output a logical 1. This in turn passes through a Darlington transistor array and is inverted to a logical 0 as the row 1 "C" output.

It should be explained that the Darlington transistor arrays used in drive modules at 50 and 60 will take a +1 input and invert it to a true 0 or ground. However, if a 0 enters the array, it is inverted to a logical 1 (+5 volts)

and is characterized by high impedance to reverse flow. The drivers 48, 58 will cause a logical 1 to be amplified from an input of +5 volts to an output of +12 volts. An input of a logical 0 or essentially ground will yield a logical 0 which is still essentially ground. The drivers have high impedance to reverse flow regardless of the input. Both the drivers and the Darlington transistor arrays will produce high impedance to reverse flow when not activated.

The output lines 62 are connected to corresponding leads (not shown) from the display module. The remaining "set" NOR gates 40 each receive two 1 inputs causing an output of a logical 0. These zeros pass through drivers 48 resulting in the "S" inputs acting as a ground for rows 2–7 of the display module 10. The remaining "clear" NOR gates 42 receive a 0 and 1 input and output a logical 0. This, passes through the Darlington transistor arrays 50 to output logical ones.

While the row outputs "C" and "S" to the display module are being activated in the above described manner, the parallel interface at D receives a signal to activate the column to be affected. In order to effect a dot in the first column, the righthand D interface input line **52*a* must be activated. This input will be a logical 1 which will pass through inverter 54 resulting in a logical 0. The circuit then branches, one part passing through another inverter 56 restoring a logical one which is then amplied by driver 58. Since the interface input D is using positive logic, this 1 which was plus 5 volts is amplified through driver 58 to plus 12 volts. The other part of the circuit which branched after inverter 54 includes a Darlington transistor array 60 which results in a 1 output characterized by high impedance as stated above. Thus, the first display unit in the first row of the first display module will receive positive 12 volts along the line corresponding to Column 1 and while receiving 0 volts through the lines corresponding to Row 1** "C" and "S" inputs. This will cause a dot showing a colored face to flip to black and one showing a black face to remain as it is when this module is used with a display module such as Ferranti-Packard Model 270XY3-35.

If it were to be desired that the dot of the display unit in the first row in the first column show its colored side, this would be done by the computer sending the same signals with the exceptions of the A input which would be 1 instead of 0 and the D input along line **52*a* which will be a 0. In such a case the C and S inputs into the display module for rows 2 through 7 would remain the same, but since NOR gate 40*a* would receive two 0s it would output a 1, which would be amplified by driver 48 to approximately +12 volts, whereas NOR gate 42*a* would receive both a 0 and 1 resulting in a logical 0 output which would be inverted by the Darlington transistor array to a logical 1 with high impedance. The D input would at the same time be inverted by inverter 54 to a logical 1 and branch. One branch passes through inverter 56 and driver 58 resulting in an output of 0 with high impedance. The other branch passes through the Darlington array 60 yielding a true ground. In such a case the current flow within the display module for the display unit at Column 1, Row 1, would be from the column 1 ground volts to the 12 volts of the "S" line of Row 1. This would result in the dot at Row 1, Column 1, in display module 1** showing its black face flipping to its colored face or remaining the same if already showing color.

In both these instances the remaining display units 12 in column 1 will be faced with high impedance along lines "C" and "S", regardless of the voltage along Column Line 1, causing all the dots to remain as previously arranged and with no current flow through the display units.

Since all of the drivers and Darlington transistor arrays are characterized by high impedance when not activated, the dots in Columns 2–5 in display module 1 will not be affected by the activity along lines C and S of the rows.

Since the D input from parallel interface are not controlled by a switch as are the rows, positive 12 volts will be fed into all of the display modules at Column Line 1, but due to the high impedance of the Darlington transistor arrays 50 and the drivers 48, none of the dots connected to the other drive modules will be affected.

After the side of the dot to be shown by the display unit in Row 1, Column 1, display module 1 is selected, the parallel interface input at B is changed so the side of the dot in Row 2, Column 1 would be selected, and so forth, until all of the dots in Column 1 correspond to the image selected. The computer then performs the same task for succeeding columns in the first display module, and so forth, in succeeding display modules.

The time involved in the manipulation in each dot is one millisecond and the computer allows the manipulation of succeeding dot almost instantaneously. Thus, the only current required for the display units of a standard 80-column display is as low as 0.25 amps for a period of under one second. It is advantageous when using display modules with electro-magnetic dots to repeat the process so that any dot which may not be turned the first time due to the presence of dust will be caught in a succeeding attempt. Due to this very low power usage, it is possible to allow the computer to repeat the program for each image two or three times and still have significant power savings over the prior art.

What is claimed is:

1. A control system for a display with a matrix of image forming display units comprising in combination:

an input device for indicating an image to be formed on the display;

a computer responsive to the input device for outputting a series of electrical pulse groups corresponding to the indicated image; and a drive module responsive to the electrical pulse groups for inducing separate unit by unit sequential formation of the indicated image by the display characterized by current flow through only one display unit at a time.

2. The control system as described in claim 1 wherein the computer includes a memory in which an image code may be stored capable of causing the computer to produce the pulse groups corresponding to the indicated image and processing means for changing the code into pulse groups.

3. The control system as described in claim 2 wherein the memory consists of an erasable programmable read-only memory unit.

4. The control system as described in claim 1 wherein the computer is a single board computer.

5. The control system as described in claim 1 wherein input device selector consists of a thumb wheel device.

6. A method for displaying images on a display module with a matrix of display units having quiescent and dynamic modes which comprises:

a. Selecting on an input device an image to be displayed;

b. Reading of the selection by a computer causing the withdrawal from a memory of a corresponding image code;

c. Converting the image code by the computer into a series of simultaneous pulse groups, each group of the series corresponding to the quiescent or dynamic mode of one and only one display unit to be used in the display of the image; and d. Directing current from each pulse group sequentially to its corresponding display unit in the display module, resulting in display of the proper mode of that unit.

7. The method for displaying images described by claim 6 further comprising repeating automatically the series of simultaneous pulse groups for each initial selection of an image.

8. The method for displaying images described by claim 6 further comprising repeatedly alternating a plurality of images on each module for each single selection on the input device.

9. A control system for a display with a matrix of image forming display units comprising in combination:

an input device for indicating an image to be formed on the display;

a computer responsive to the input device for outputting a series of electrical pulse groups corresponding to the indicated image;

a drive module responsive to the electrical pulse groups for inducing separate unit-by-unit sequential formation of the indicated image by the display characterized by current flow through only one display unit at a time; and additional drive and display modules where each drive module is interchangeable with all other drive modules but with each drive module operating independently of the other drive modules when a module selector switch included on each drive module is set differently from the module selector switches on the other drive modules.

* * * * *